US005131803A

United States Patent [19]

Banek

[11] Patent Number: 5,131,803

[45] Date of Patent: Jul. 21, 1992

[54] METHOD FOR STACKING MEAT PATTIES

[75] Inventor: Todd M. Banek, Greeley, Colo.

[73] Assignee: Monfort, Inc., Greeley, Colo.

[21] Appl. No.: 613,090

[22] Filed: Nov. 6, 1990

[51] Int. Cl.[5] ..... B65G 57/14; B07C 5/34

[52] U.S. Cl. ..... 414/786; 414/790.4; 414/794.4; 414/788.7; 209/571; 209/655; 53/475; 53/247

[58] Field of Search ..... 209/571, 567, 655; 414/794.4, 794.5, 789.9, 788.7, 790.4, 790.7, 791.1; 53/475, 531, 539, 247; 426/108, 129

[56] References Cited

U.S. PATENT DOCUMENTS

| | | | |
|---|---|---|---|
| 2,392,032 | 1/1946 | Domville et al. | 414/791.1 X |
| 2,859,859 | 11/1958 | Winkel et al. | 414/790.4 |
| 3,268,073 | 8/1966 | Lehde et al. | 209/567 |
| 3,283,899 | 11/1966 | Vedvik et al. | 209/567 X |
| 3,394,806 | 7/1968 | Vaillette | 209/655 X |
| 3,752,043 | 8/1973 | Rapparlie et al. | 414/794.4 X |
| 3,822,008 | 7/1974 | Benner et al. | 414/790.4 |
| 3,866,741 | 2/1975 | Carbon et al. . | |
| 3,915,316 | 10/1975 | Pomara, Jr. . | |
| 3,959,951 | 6/1976 | Paules | 414/794.4 X |
| 3,991,168 | 11/1976 | Richards et al. . | |
| 3,998,339 | 12/1976 | Booth . | |
| 4,026,421 | 5/1977 | Lotz | 414/790.4 |
| 4,137,604 | 2/1979 | Sandberg et al. . | |
| 4,285,621 | 8/1981 | Spencer | 414/790.4 X |
| 4,405,186 | 9/1983 | Sandberg et al. . | |
| 4,463,944 | 8/1984 | Grantham | 414/790.7 X |
| 4,529,082 | 7/1985 | Mally . | |
| 4,543,864 | 10/1985 | Hochanadel et al. . | |
| 4,719,421 | 1/1988 | Kerr | 209/567 X |
| 4,759,433 | 7/1988 | Kraft | 198/422 |
| 4,824,307 | 4/1989 | Johnson et al. | 414/790.4 X |
| 4,827,692 | 5/1989 | Fiske et al. | 53/244 |
| 5,006,040 | 4/1991 | Frey | 414/794.4 X |
| 5,044,876 | 9/1991 | Stohlquist | 414/790.4 X |

FOREIGN PATENT DOCUMENTS

| | | | |
|---|---|---|---|
| 189693 | 12/1985 | European Pat. Off. | 414/794.4 |

*Primary Examiner*—Robert J. Spar
*Assistant Examiner*—Brian Dinicola
*Attorney, Agent, or Firm*—Sheridan, Ross & McIntosh

[57] ABSTRACT

Method for stacking substantially flat products such as meat patties. Rows of patties are conveyed under a metal detector and then to a sigmoidal slide. Patties contaminated with metal trigger the metal detector to send a signal to the slide. Upon receipt of a signal from the metal detector, the slide pivots in a manner to dispose of metal contaminated patties. Uncontaminated patties are conveyed down the slide without flipping over and onto a second lower conveyor having a plurality of vertical blades mounted thereto, between which patties are received in stacks. An optical counter is mounted to count patties conveyed down the slide. The counter is in communication with the second indexed conveyor and signals such conveyor to move forward after a predetermined number of patties have been stacked between two adjacent vertical blades on the indexed conveyor. Stacks of patties are then conveyed on the second conveyor to a packing station where workers can grasp the stacks with each of their hands for packing into distribution boxes.

11 Claims, 3 Drawing Sheets

METHOD FOR STACKING MEAT PATTIES

Field of the Invention

This invention relates to a method and apparatus for forming organized stacks of products and particularly relates to a method and apparatus for selecting acceptable meat patties, counting such patties and stacking such patties in substantially aligned and uniform stacks for incorporation into distribution packages.

Background of the Invention

In packaging products such as meat patties for subsequent distribution, it is desirable to have the patties organized in stacks to facilitate easy handling and transfer of patties into packing boxes. In conventional meat pattie stacking methods and apparatuses, meat patties are often flipped or vertically dropped into stacked arrangement, creating misalignment of pattie stacks. Prior art methods and apparatuses which produce irregular pattie stacks delay a worker's handling of such stacks, thus slowing the entire packaging process.

Moreover, prior art methods and apparatuses fail to address ergonomic concerns. For example, conventional methods often require a worker to use both of his/her hands when transferring patties from a conveyor into packaging boxes. The lack of efficiency of prior art methods also adds considerably to worker fatigue and adds significantly to the overall costs of the packaging operation.

In prior art methods and apparatuses that form stacks by flipping meat patties, patties often fail to complete a 180° rotation and thus land on their sides, damaging the individual pattie as well as the stack into which the pattie falls. Removing improperly stacked patties results in significant inefficiencies and delays in the packaging process.

Numerous types of prior art stacking devices are known. For example, U.S. Pat. No. 3,998,339 by Booth discloses a pattie stacker which conveys a selected number of patties to form a substack on a stacker plate, subsequently removes the stacker plate and allows the substack to vertically drop into a finished stack. U.S. Pat. No. 4,759,433 by Kraft discloses an apparatus for stacking products one on top of the other by flipping the product 180° onto the top of other patties to form a stack. U.S. Pat. No. 3,915,316 by Pomara discloses an apparatus for counting and stacking flat articles in which the articles are stacked against vertical tines positioned above a moving conveyor of laterally spaced belts. After a predetermined number of articles are stacked against the tines, the tines are rapidly retracted downward and the stack of articles are discharged on the moving conveyor.

Other prior art inventions use mechanical means to straighten stacks after an initial stacking procedure. For example, U.S. Pat. No. 4,827,692 by Fiske discloses a mechanism for packaging hamburger patties wherein a continuously growing column of hamburger patties is created from a bottom-fed stacking device Fiske teaches the use of gripping means to manipulate stacked patties into columnar structures.

Other inventions relate to forming stacks from sliced food patties such as sliced sausage patties. For example, U.S. Pat. No. 4,529,082 by Mally discloses a method and apparatus for aligning nonuniform stacks of sliced meat patties.

U.S. Pat. No. 3,866,741 by Carbon discloses a stacker which conveys meat patties to the end of an input conveyor where the patties flip 180° and fall onto a stationary stacking conveyor. To enable individual patties to rotate through a 180° flip, the input conveyor must be positioned a certain defined distance above the stacking conveyor. The distance with which each pattie must fall, together with the non-uniformity of each flip of individual patties, results in the formation of misaligned pattie stacks. The Carbon apparatus includes a retractable separator guide which is mounted above the stacking conveyor, providing a space into which successive rows of patties fall to form pattie stacks. When a specified number of patties are stacked, the separator guide is lifted, the stacking conveyor is activated and the stacked patties are moved forward. The sudden lifting of the separator guide and the coincident movement forward of the pattie stack, disturbs the stack, causing individual patties to fall from the top of the stack and often into other stacks, resulting in a domino effect. The non-uniform partial stacks are then conveyed on the stacking conveyor in a disheveled state, making the task of picking up individual stacks difficult. Workers must use both hands to grab and organize the patties into stacks in order to remove the patties from the conveyor for packaging into shipping boxes.

Because the size of each stack can vary in prior art devices, depending upon whether the stack has fallen over or has had patties fall off, workers must expend additional time organizing appropriate stacks of patties to ensure that each box contains a specified number of patties.

In view of the above, a new method and apparatus is needed to consistently stack products in uniform and aligned stacks and to efficiently and effectively transfer such stacks to a packaging station. A method and apparatus is needed which can smoothly transfer products without the products rotating or falling from too great a height, in order to reduce the damage to individual products or to product stacks and to improve the efficiency of the whole packaging operation. An ergonomic method and apparatus is also needed in which workers can transport stacks of products from a conveyor into packaging boxes by using only one hand per stack. Additionally, a method and apparatus are needed which can detect defects, such as the presence of metal in the products and efficiently reject such defective products without a significant delay in the packaging operation.

Summary of the Invention

The present invention includes a method and apparatus for transferring substantially flat products such as meat patties from one moving conveyor onto another lower conveyor without flipping the products in the process. The invention further includes a method and apparatus for aligning successive rows of products into a stacked arrangement on a conveyor, the conveyor having a plurality of parallel spaced blades mounted thereon, between which products are received. The products are held in organized stacks during transport to a final packaging station. The present invention also provides a method and apparatus for detecting and disposing of metal contaminated products without undue delay in the packaging operation.

In one embodiment of the present invention, patties are conveyed through a metal detector on a continuously moving conveyor surface. The metal detector inspects each row of patties being conveyed to determine whether any metal particles may be present in one or more of the patties. When metal particles are detected in a pattie, the metal detector sends a signal to a pivotally mounted slide, such slide being responsive to such signals. Upon receipt of a signal, the slide is pivoted to discharge metal contaminated patties into a disposal bin.

The slide, in one embodiment of the invention, is pivotally mounted at an angle to receive patties from a first conveyor and transport the patties to a lower indexing conveyor. The slide is preferably sigmoidal in shape and positioned at an angle which allows for the efficient transport of patties to the indexed conveyor without the patties flipping over in the process.

In another embodiment of the invention, a counter is provided for counting patties transferred down the slide. The counter is preferably an optical sensing device and one or more of such counters may be positioned to register the number of pattie rows being transported down the slide and onto the indexed conveyor.

The indexed conveyor of the present invention is preferably provided with a plurality of parallel blades mounted approximately one pattie length from each other, between which stacks of meat patties are formed. Side walls to the indexed conveyor are also provided in one embodiment to facilitate the gathering of pattie stacks by packaging employees.

In a further embodiment of the invention, a control device activates the indexed conveyor after receiving signals from the counter, thus moving the indexed conveyor forward to allow for further stacks of patties to be formed in an additional space between two parallel spaced blades.

Detailed Description of the Invention

In accordance with the present invention, a method and apparatus are disclosed for stacking substantially flat products of generally uniform size and dimension. Although various products can be stacked with the present invention, it is especially useful for stacking "patties " As used herein, "patties" refers generally to flat food products and in particular to meat patties. For the sake of simplicity, the following description of the invention will be directed to the stacking of patties. However, it is to be expressly understood that the present invention can be practiced with other products, such as tortillas, cookies, pie pans, etc.

In a preferred embodiment, the invention relates to the transport of partially frozen, preformed meat patties from a first conveyor to a second conveyor to form uniform and aligned stacks of patties which are ready for packaging into distribution boxes. The ease with which such uniform stacks can be handled by employees in pattie packaging operations results in significant improvements in efficiency, and thus reduces the costs associated with the pattie packaging process.

The present invention is particularly adapted for use with partially frozen or frozen meat patties, as opposed to fresh meat patties. Patties may be initially formed and placed on wax paper or the like, and thereafter conveyed through either a spiral or tunnel refrigeration unit wherein carbon dioxide or nitrogen environments are used to cool the meat quickly. Frozen or partially frozen meat patties are less susceptible to deformation during the stacking process and may be better handled by employees during the packing of meat pattie stacks into distribution boxes.

Figure 1:
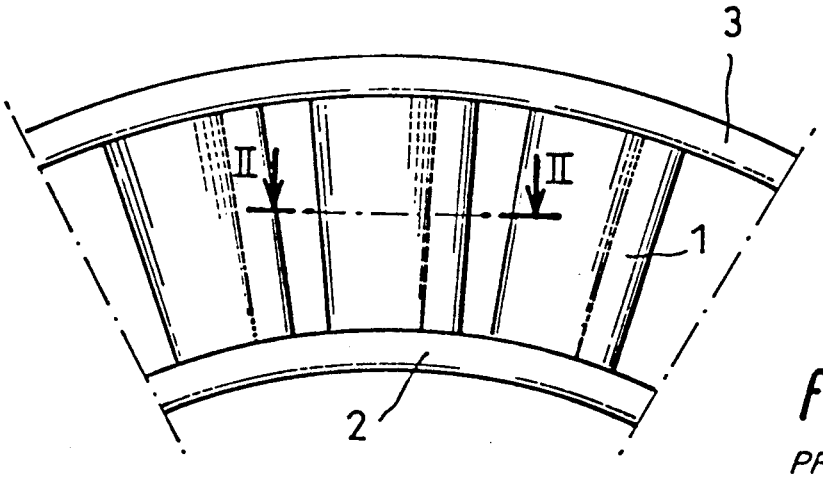
fig 1 PRIOR ART
FIG. 1 is a side elevation view of an embodiment of the apparatus of the present invention.
Figure 2:
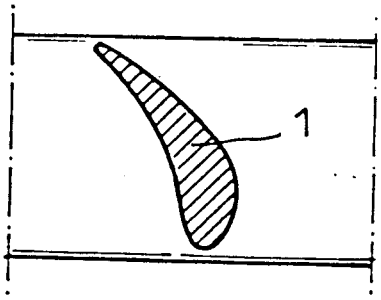
fig 2 PRIOR ART
FIG. 2 is a top plan view of the apparatus shown in FIG. 1.

In general, the present invention includes a device for moving successive rows of patties in the same direction. In a preferred embodiment, the device for moving comprises a conveyor. Referring to FIG. 1, preformed, partially frozen patties 10 are transferred on a first conveyor 12 which includes an endless band 14, trained about rollers 16, 18. The first conveyor 12 can have substantially vertical blades mounted thereto to assist in the registration of rows of patties 10. The first conveyor 12 transfers patties from a refrigerated environment (not shown) toward a packing station 20. As shown in FIG. 2, patties 10 are in a row of about three to fifteen patties 10 in each row, more preferably three to ten patties 10 and most preferably four to six patties 10.

In one embodiment of the present invention, a metal detector 22 is positioned directly above the first conveyor 12. The metal detector 22 senses the presence of metal particles that may have entered patties 10 during prior processing. In a preferred embodiment, the metal detector 22 is mounted separately from the first conveyor 12 to avoid any disruptive vibration that may be caused by the operation of the first conveyor 12.

A device is provided that can transport patties from the first conveyor to a second lower conveyor. In one embodiment of the invention, this device is a slide 24 positioned in relation to the first conveyor 12 so as to avoid any hindrance of patties 10 being transferred from the first conveyor 12 to the slide 24. The slide 24 is preferably pivotally mounted at an angle sufficient to facilitate the smooth conveyance of patties 10 down the slide 24, but is not mounted at so steep an angle as to allow for patties to flip or rotate. The slide 24 is preferably constructed from stainless steel, but other suitable materials can also be used. In particular, the slide 24 can comprise a bar roller 35B. (See FIG. 4). The bar roller 35B comprises a plurality of freely rotatable cylinders mounted adjacent to each other, that permit patties 10 placed thereon to be conveyed with minimal friction. The bar roller 35B is preferably of sufficient dimension to receive a row of patties 10 and is mounted so that patties 10 conveyed on the slide 24 are transported to the second conveyor 32 without flipping over.

While embodiments of the invention wherein a bar roller 35B makes up the slide 24 are possible (See FIG. 4), the slide 24 is preferably constructed using a stainless steel flat portion 27 or a sigmoidal portion 25, in combination with a bar roller 35A and 35C due to difficulties encountered by solely using a bar roller 35B as the slide 24. Such difficulties include the sticking of individual rollers within a bar roller 35B due to meat falling between the rollers, freezing of water on the bar roller, etc.

Figure 5:
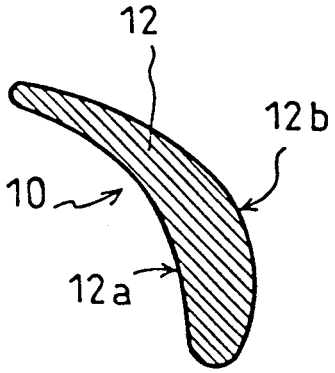
FIG. 5 is a close up view of a sigmoidal embodiment of the slide.
Figure 6A:
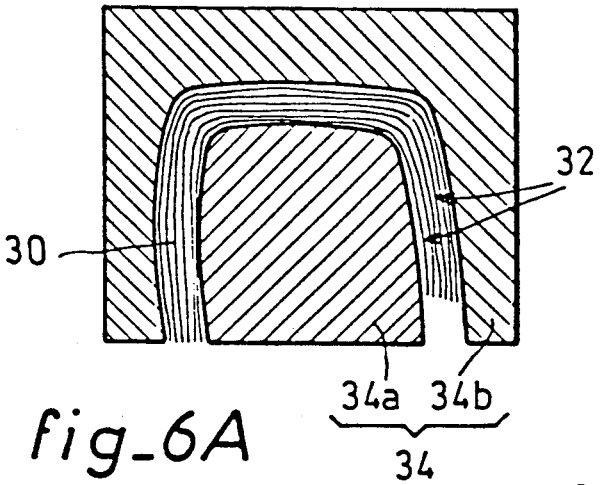
Figure 6B:
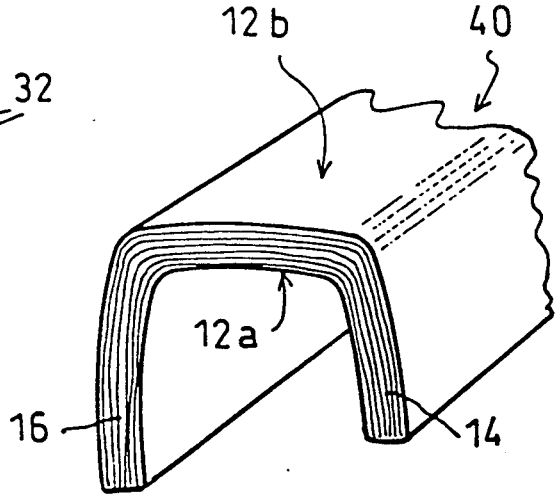
Figure 6C:
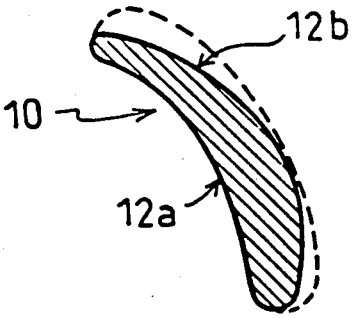
Figure 7:
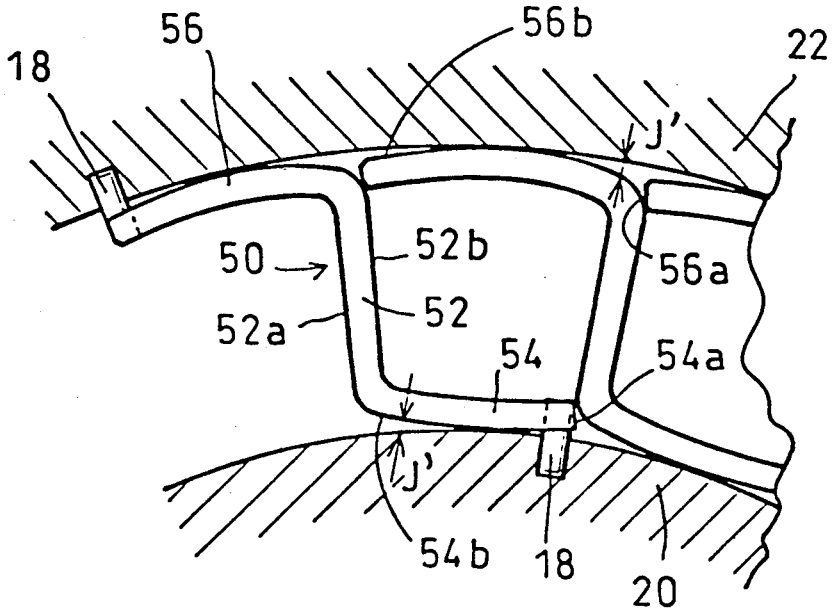
Figure 8:
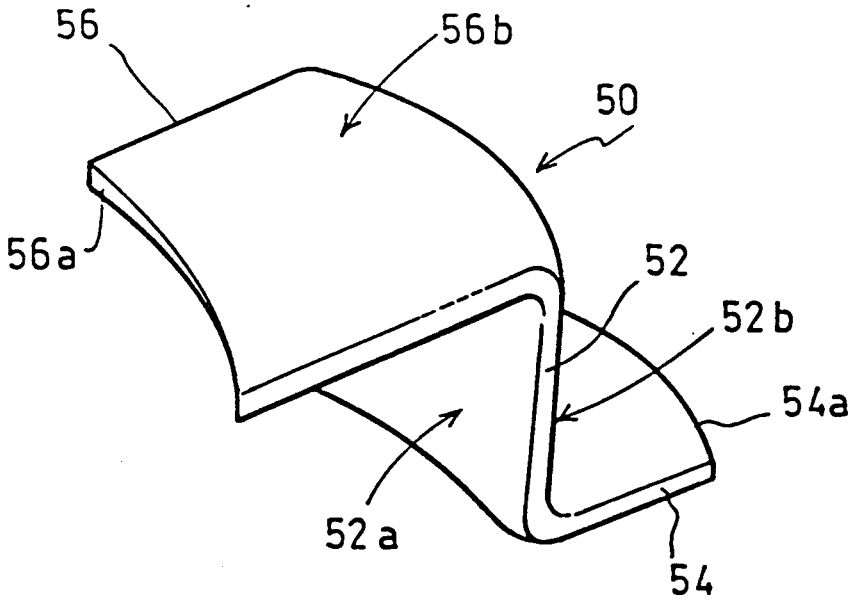
Figure 1:
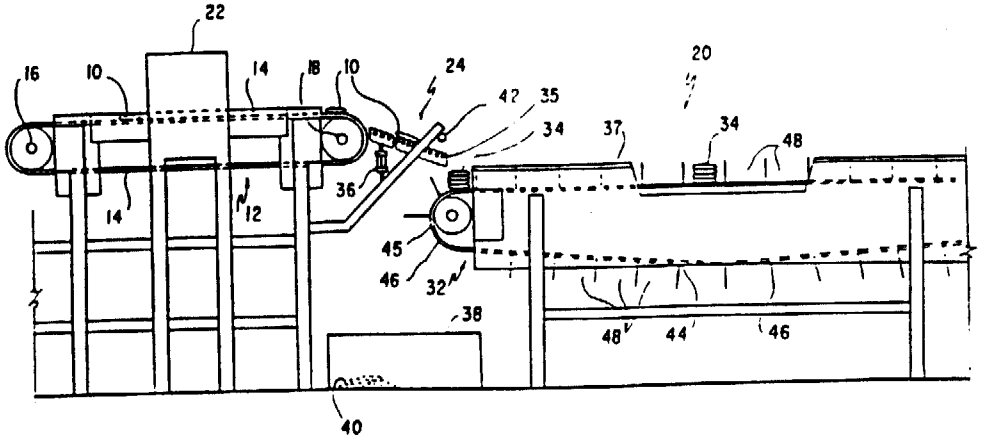
Figure 2:
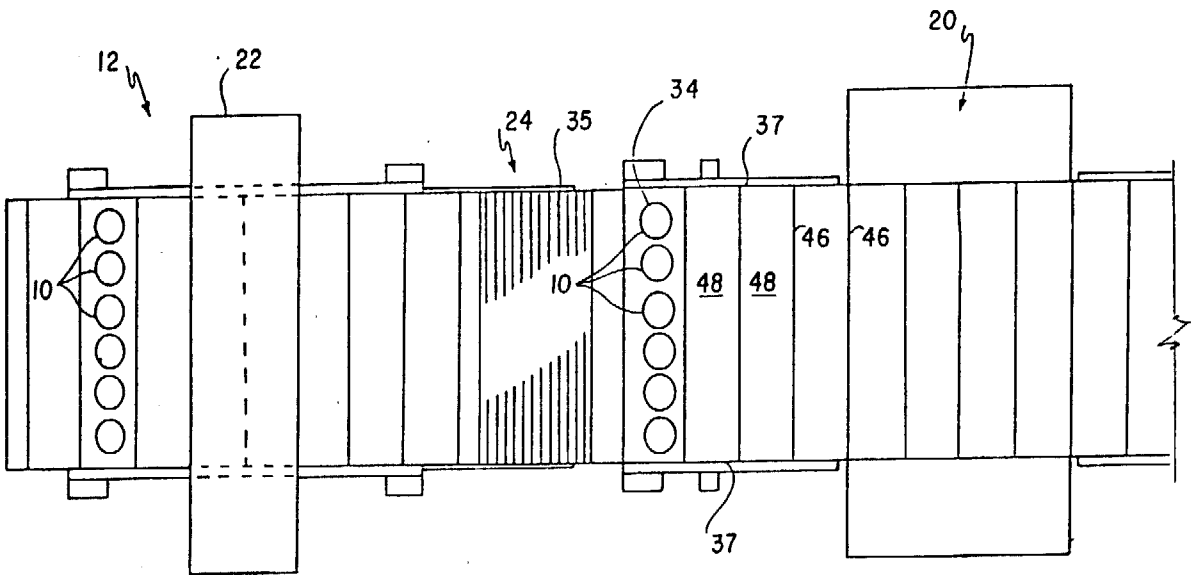
Figure 3:
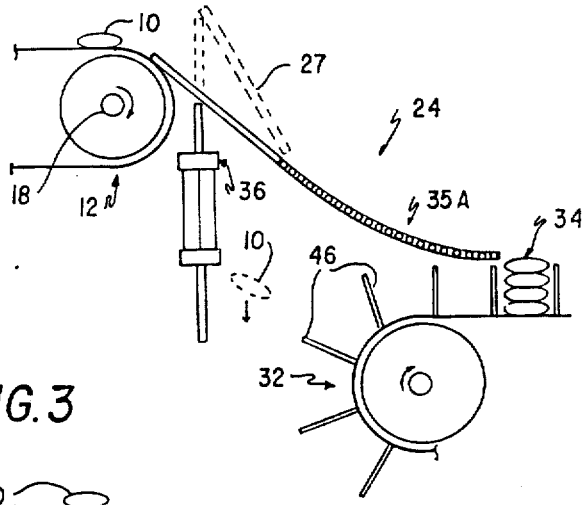
Figure 4:
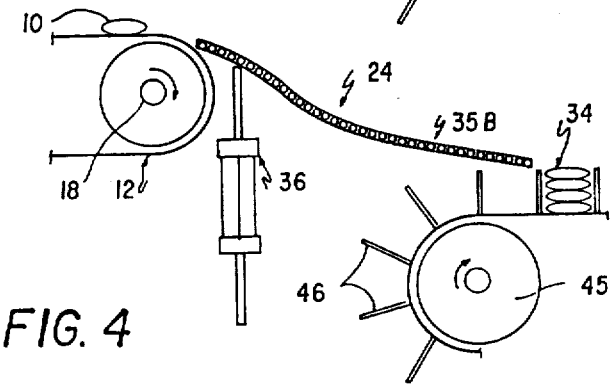
Figure 5:
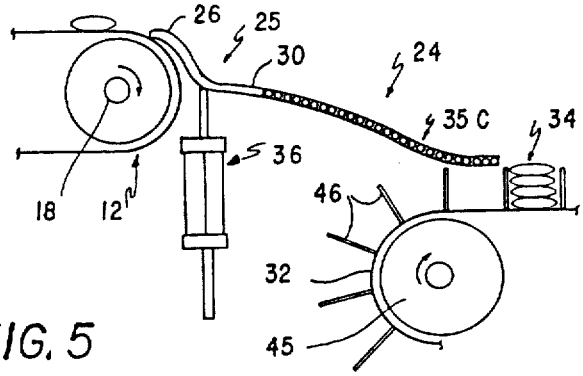

In a preferred embodiment, as shown in FIG. 5, a sigmoidal portion 25 of the slide 24 provides a generally short horizontal surface 2 to receive patties 10 from the first conveyor 12, a middle angled section 28 to allow the pattie 10 to be transported downward, and a final generally horizontal section 30 for transport of patties 10 onto the bar roller section 35C of the slide 24 and then to a second conveyor 32. The bar roller portion 35C is mounted directly below the sigmoidal portion 25 of the slide 24 to receive patties 10 transported by the sigmoidal portion 25 and to convey such patties 10 onto a second indexed conveyor 32. The patties 10 preferably exit the bar roller 35C at a speed and horizontal angle that allows each individual pattie 10 to be aligned atop of other patties 10 to form a substantially organized stack 34, while preventing damage which results from individual patties 1 striking the stack 34 at an angle which deviates too greatly from the horizontal.

In one embodiment of the present invention, a slide positioning device 36 is provided for controlling the position of the slide 24. Such slide positioning device 36 is able to receive signals produced by the metal detector 22. When a meat pattie 10 contaminated with metal passes under the metal detector 22 a signal is generated which activates the slide positioning device 36.

Figure 3:
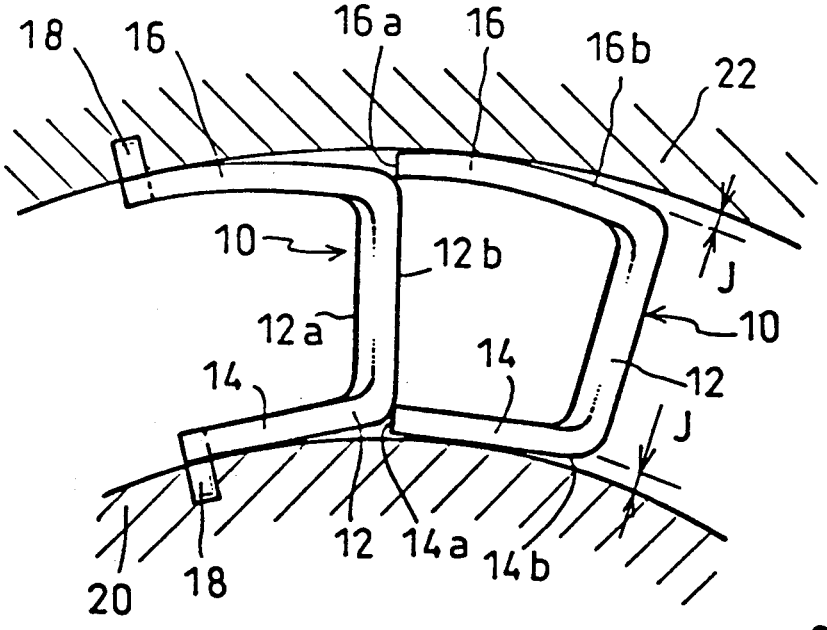
FIG. 3 is a close up view of an embodiment of the slide showing the second position in phantom for disposing of product.
Figure 4:
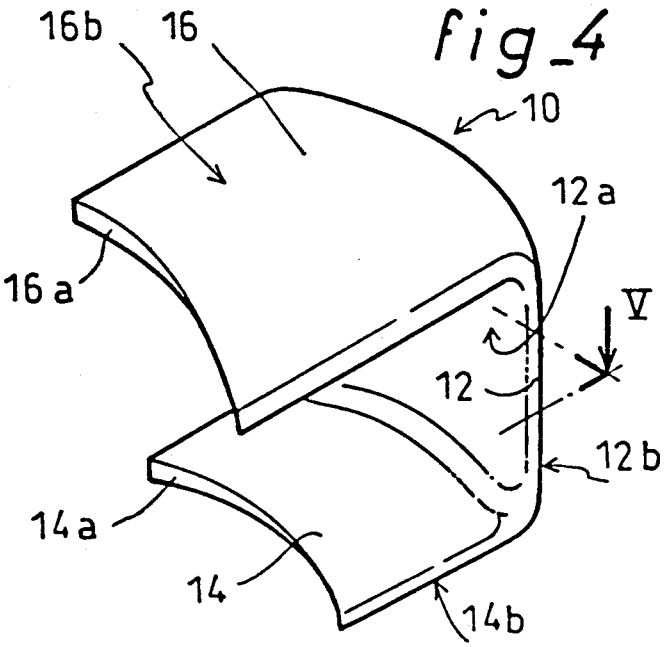
FIG. 4 is a close up view of an embodiment of the bar roller slide.

In one embodiment as shown in FIG. 3, the slide positioning device 36 is a piston, either pneumatically or hydraulically controlled, mounted to a substantially flat portion 27 of the slide 24 in such a manner as to reversibly move the flat portion 27 of the slide 24 from a first normal position, which permits patties 10 to be transported from the first conveyor 12 down the flat portion 27 of the slide 24, into an second activated position (shown in phantom in FIG. 3), which permits patties 10 to fall into a disposal bin 38 (See FIG. 1). Thus, upon receipt of a signal from the metal detector 22, the slide positioning device 36 is activated, pivoting flat portion 24 of the slide 24 in such a manner that the row of meat patties 10 in which metal has been detected is directed into a receiving bin 38. The control device 36 then returns the flat portion 27 of the slide 24 to its normal functioning position to receive additional rows of patties 10. When the flat portion 27 of the slide 24 is not activated, patties 10 proceed down the flat portion 27 of the slide 24 and onto a bar roller portion 35A of the slide 24 for transport to a second conveyor 32. In another embodiment, as shown in FIG. 4, the bar roller 35B is directly connected to the control device 36. The bar roller 35B receives patties from the first conveyor 12 for transport to the second indexed conveyor 32. Other control devices such as springs, levers, cams, etc., can also be employed.

Other embodiments of the invention include various ways to activate the slide 24 in order to dispose of patties 10. For example, the control device 36 can angularly adjust the slide 24 at a time when the meat pattie 10 containing metal is on the slide's surface, thereby causing the pattie 10 to be conveyed down the slide 24 at a steep angle and into a receiving bin 38. The objective in all embodiments is to dispose of contaminated patties 10 in a quick and efficient manner so that the overall packaging process is not delayed.

In another embodiment of the invention (See FIGS. 1 and 2), a counter 42 is provided to count the number of meat patties 10 transferred down the slide 24. In a preferred embodiment, the counter 42 is an optical sensing device which registers each time a pattie 10 is passed beneath its optical eye. The counter 42 is positioned so that it only counts meat patties 10 that are transferred down the slide 24 and onto the second conveyor 32. In this way, meat patties 40 rejected because they contain metal particles are not be registered by the counter, allowing accurate counts of packaged patties to be maintained. The counter 42 is preferably placed as close as possible to the meat patties 10 passing down the slide 24 and is in a position to "see" any meat patties 10 that may be slightly out of line with other meat patties 10 within a given row. In another embodiment of the invention, numerous optical counting devices can be used to detect each individual pattie 10 being transferred down the slide 24.

A further feature of the invention is a second indexed conveyor 32 in general longitudinal alignment with the first conveyor 12. In a preferred embodiment, the second conveyor 32 comprises a driven endless belt 44 trained over one or more rollers 45 (only one shown). The second conveyor 32 is positioned below the discharge end of the first conveyor 12 and below the slide 24. At such position, the second conveyor 32 sequentially receives patties 10 being transferred from the first conveyor 12 down the slide 24. The indexed conveyor 32 is provided with a plurality of parallel partitions 46 mounted substantially perpendicular to the conveyor's direction of movement. The partitions 46 are separated by approximately the width of a single pattie, and are of sufficient height to allow for the alignment of stacks 34 of a predetermined height. When patties 10 are transferred down the slide 24 and onto the indexed conveyor 32, they are guided into a stacked relationship against each one of the plurality of substantially parallel, laterally spaced partitions 46 mounted to the second conveyor 32. The partitions 46 stop the forward progress of patties 10 transferred down the slide 24 and act to align the patties 10 received in a stacked relationship. Side walls 37 are also provided on each side of the indexed conveyor 32, further aligning and organizing the stacks of patties 10 being transported to the packing station 20.

In a preferred embodiment, the second conveyor 32 is moved forward in indexed steps in an intermittent forward motion, stopping to receive a predetermined number of patties 10 in a stacked arrangement 34 between each adjacent pair of parallel partitions 46 mounted on the second conveyor 32. An intermittent drive device (not shown) is provided which operatingly connects the counter 42 and the indexed conveyor 32 to control the indexed movement of the indexed conveyor 32, such device able to receive signals from the counter 42. Thus, when a predetermined number of patties 10 have been stacked in the space 48 between two adjacent partitions 46 on the indexed conveyor 32, the intermittent drive device receives a signal and activates the indexed conveyor 32 to move it forward, providing a new space 48 between two partitions 46 on the indexed conveyor 32 to receive additional patties 10 to be stacked. The intermittent drive device is preferably controlled by either pneumatic or hydraulic means.

The intermittent drive device for the second conveyor is preferably mounted on one of the rollers 45 controlling the second conveyor 32, and is able to receive signals from the counter 42 in order to trigger forward indexed movement of the conveyor 32.

By use of the present invention, the efficiency of the pattie stacking and packing process is greatly increased. In addition, because the invention better organizes pattie stacks, it is more ergonomic for workers, causing less stress on the job and less physical discomfort in the performance of routine duties. In particular, workers whose job it is to physically pick up individual stacks 34 of patties 10 and place such stacks 34 into distribution boxes, are able to use each of their hands separately to pick up and place pattie stacks 34 into distribution boxes. The aligned stacks 34 positioned between the blades 46 on the second conveyor 32 allow workers to either grasp individual stacks 34 from a row of stacks 34, or to move aligned stacks 34 between the blades 46 to the side wall 37 and then grasp each stack 34 as it is biased against the side wall 37. This ability to grasp stacks 34 with a single hand results in significant advantages in efficiency, permitting the overall packing process to proceed at a faster rate without undue stress on workers.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. A method of stacking meat patties comprising:

(a) providing a first conveyor means having a first inlet end and a first discharge end;

(b) providing a second conveyor means downstream from and below said first conveyor means, said second conveyor means having a second inlet end and a second discharge end;

(c) providing a slide having a slide surface and extending between said first discharge end and said second inlet end, said slide having an upper end substantially adjacent to said first discharge end and a lower end substantially adjacent to said second inlet end;

(d) depositing said meat patties on said first conveyor means at said first inlet end and conveying said meat patties along a substantially horizontal path of conveyance to said first discharge end, each of said meat patties having a center of gravity and having a horizontal axis passing though said center of cavity in a direction transverse to said path of conveyance;

(e) testing each meat pattie to be transferred onto said slide surface for metal content and moving said slide's upper end away from said path of conveyance when metal is detected in a pattie to be transferred;

(f) transferring a meat pattie not containing metal from said first discharge end to said slide upper end, said patties sliding along said slide surface and onto said second conveyor means at said second inlet and without rotating more than 90 degrees about said horizontal axis during said step of transferring;

(g) repeating steps (d) through (f) until a stack of patties is formed at said second inlet end; and (h) advancing said second conveyor means so that a new stack may be formed at said second inlet end.

2. A method as set forth in claim 1, wherein said slide is substantially sigmoidal in shape.

3. A method as set forth in claim 1, wherein said slide comprises a bar roller.

4. A method as set forth in claim 1, wherein said counter is an optical device.

5. A method as set forth in claim 1, further comprising:

(a) providing an intermittent drive device for activating said second conveyor;

(b) providing a counting means able to transmit a signal to said intermittent drive device to activate said second conveyor after a desired number of meat patties have been transferred shown said slide.

6. A method as set forth in claim 5, wherein said intermittent drive device is operated pneumatically.

7. A method as set forth in claim 5, wherein said intermittent drive device is operated hydraulically.

8. A method as set forth in claim 1 further comprising the steps of:

(a) allowing a pattie containing metal to drop between and below said first discharge end and said slide surface after said slide upper end is moved; and (b) returning said slide upper end to its position adjacent said first discharge end.

9. A method as set forth in claim 1, further comprising the step of counting said meat patties sliding on said slide during said transferring step.

10. The method as set forth in claim 1 wherein said step of providing a second conveyor means includes providing a plurality of substantially parallel spaced partitions for receiving said stacks of meat patties therebetween.

11. A method for stacking meat patties comprising the steps of:

(a) providing a first conveyor means having a first inlet end and a fist discharge end;

(b) providing a second conveyor means downstream from and below said first conveyor means, said second conveyor means having a second inlet end and a second discharge end;

(c) depositing said meat patties on said first conveyor means at said first inlet and and conveying said meat patties along a substantially horizontal path of conveyance to said first discharge end, each of said meat patties having a center of gravity and having a horizontal axis passing through said center of cavity in a direction transverse to said path of conveyance;

(d) providing a metal detector positioned above said first conveyor means;

(e) providing a means for diverting meat patties having metal therein away from said second conveyor, said diverting means being in operational communication with said metal detector;

(f) testing a meat pattie for metal convent before it reaches the first discharge end;

(g) transferring a meat pattie when no metal is detected during said testing step from said discharge end of said first conveyor means onto said inlet end of said second conveyor means without rotating said meat pattie more than 90 degrees about said horizontal axis;

(h) diverting a meat pattie away from said second conveyor means with said diverting means before said transferring step if metal is detected in said pattie during said testing step;

(i) repeating steps (f) through (h) until a stack containing a predetermined quantity of meat patties is formed on said second conveyor means; and (j) advancing said second conveyor means so that a new stack of meat patties may be formed at said second inlet end.

* * * * *

UNITED STATES PATENT AND TRADEMARK OFFICE

CERTIFICATE OF CORRECTION

PATENT NO. : 5,131,803

DATED : July 21, 1992

INVENTOR(S) : Todd M. Banek

It is certified that error appears in the above-identified patent and that said Letters Patent is hereby corrected as shown below:

The title page showing the illustrative figures should be deleted to appear as per attached title page.

The sheets of drawings consisting of figures 1-8, should be deleted to be replaced with figures 1-5 as shown on the attached sheets.

Signed and Sealed this

Twenty-fourth Day of August, 1993

*Attest:*

*Attesting Officer*

BRUCE LEHMAN

*Commissioner of Patents and Trademarks*

United States Patent [19]

Banek

[11] Patent Number: 5,131,803

[45] Date of Patent: Jul. 21, 1992

[54] METHOD FOR STACKING MEAT PATTIES

[75] Inventor: Todd M. Banek, Greeley, Colo.

[73] Assignee: Monfort, Inc., Greeley, Colo.

[21] Appl. No.: 613,090

[22] Filed: Nov. 6, 1990

[51] Int. Cl.[5] ..... B65G 57/14; B07C 5/34

[52] U.S. Cl. ..... 414/786; 414/790.4; 414/794.4; 414/788.7; 209/571; 209/655; 53/475; 53/247

[58] Field of Search ..... 209/571, 567, 655; 414/794.4, 794.5, 789.9, 788.7, 790.4, 790.7, 791.1; 53/475, 531, 539, 247; 426/108, 129

[56] References Cited

U.S. PATENT DOCUMENTS

| | | | |
|---|---|---|---|
| 2,392,032 | 1/1946 | Domville et al. | 414/791.1 X |
| 2,859,859 | 11/1958 | Winkel et al. | 414/790.4 |
| 3,268,073 | 8/1966 | Lehde et al. | 209/567 |
| 3,283,899 | 11/1966 | Vedvik et al. | 209/567 X |
| 3,394,806 | 7/1968 | Vaillette | 209/655 X |
| 3,752,043 | 8/1973 | Rapparlie et al. | 414/794.4 X |
| 3,822,008 | 7/1974 | Benner et al. | 414/790.4 |
| 3,866,741 | 2/1975 | Carbon et al. . | |
| 3,915,316 | 10/1975 | Pomara, Jr. . | |
| 3,959,951 | 6/1976 | Paules | 414/794.4 X |
| 3,991,168 | 11/1976 | Richards et al. . | |
| 3,998,339 | 12/1976 | Booth . | |
| 4,026,421 | 5/1977 | Lotz | 414/790.4 |
| 4,137,604 | 2/1979 | Sandberg et al. . | |
| 4,285,621 | 8/1981 | Spencer | 414/790.4 X |
| 4,405,186 | 9/1983 | Sandberg et al. . | |
| 4,463,944 | 8/1984 | Grantham | 414/790.7 X |
| 4,529,082 | 7/1985 | Mally . | |
| 4,543,864 | 10/1985 | Hochanadel et al. . | |
| 4,719,421 | 1/1988 | Kerr | 209/567 X |
| 4,759,433 | 7/1988 | Kraft | 198/422 |
| 4,824,307 | 4/1989 | Johnson et al. | 414/790.4 X |
| 4,827,692 | 5/1989 | Fiske et al. | 53/244 |
| 5,006,040 | 4/1991 | Frey | 414/794.4 X |
| 5,044,876 | 9/1991 | Stohlquist | 414/790.4 X |

FOREIGN PATENT DOCUMENTS

| | | | |
|---|---|---|---|
| 189693 | 12/1985 | European Pat. Off. | 414/794.4 |

*Primary Examiner*—Robert J. Spar
*Assistant Examiner*—Brian Dinicola
*Attorney, Agent, or Firm*—Sheridan, Ross & McIntosh

[57] ABSTRACT

Method for stacking substantially flat products such as meat patties. Rows of patties are conveyed under a metal detector and then to a sigmoidal slide. Patties contaminated with metal trigger the metal detector to send a signal to the slide. Upon receipt of a signal from the metal detector, the slide pivots in a manner to dispose of metal contaminated patties. Uncontaminated patties are conveyed down the slide without flipping over and onto a second lower conveyor having a plurality of vertical blades mounted thereto, between which patties are received in stacks. An optical counter is mounted to count patties conveyed down the slide. The counter is in communication with the second indexed conveyor and signals such conveyor to move forward after a predetermined number of patties have been stacked between two adjacent vertical blades on the indexed conveyor. Stacks of patties are then conveyed on the second conveyor to a packing station where workers can grasp the stacks with each of their hands for packing into distribution boxes.

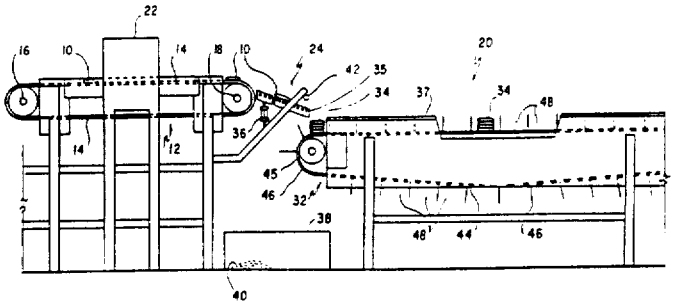

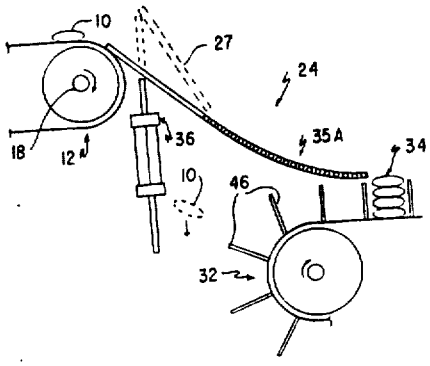

11 Claims, 3 Drawing Sheets